US005253681A

United States Patent [19]

Cramer et al.

[11] Patent Number: 5,253,681

[45] Date of Patent: Oct. 19, 1993

[54] REED FOR FORMING A GAP IN THE FABRIC PRODUCED ON AN AIR WEAVING LOOM

[75] Inventors: Gottfried Cramer; Gerhard Hofmaier, both of Lindau, Fed. Rep. of Germany

[73] Assignee: Lindauer Dornier Gesellschaft mbH, Lindau, Fed. Rep. of Germany

[21] Appl. No.: 946,739

[22] Filed: Sep. 17, 1992

[30] Foreign Application Priority Data

Sep. 19, 1991 [DE] Fed. Rep. of Germany ..... 4131167

[51] Int. Cl.[5] ..... D03D 49/62

[52] U.S. Cl. ..... 139/192; 139/302; 139/430; 139/435.6

[58] Field of Search ..... 139/190, 192, 430, 433, 139/431, 302, 303, 435.5, 435.6, 191, 188 A, 27, 434

[56] References Cited

U.S. PATENT DOCUMENTS 4,275,773 6/1981 Shibata ..... 139/302 X
4,432,399 2/1984 Bachmann et al. ..... 139/435.6 X
4,905,741 3/1990 Wahhoud et al. ..... 139/302 X

*Primary Examiner*—Andrew M. Falik
*Attorney, Agent, or Firm*—W. G. Fasse

[57] ABSTRACT

The reed of an air weaving loom is divided into spaced sections for forming a fabric gap. The warp threads are guided through the reed sections, but are absent in a zone of the fabric gap. The weft threads that would bridge the fabric gap are cut in the gap and formed into a selvage. The gap, is formed where the reed sections are spaced from each other to form a breach. A reed filler member is mounted in a stationary position in the reed breach, so that the filler member aligns with the reed sections when the reed is in the rear position. Only the reed sections perform the beat-up motion.

3 Claims, 3 Drawing Sheets

REED FOR FORMING A GAP IN THE FABRIC PRODUCED ON AN AIR WEAVING LOOM

FIELD OF THE INVENTION

The invention relates to an air weaving loom with an apparatus for forming a gap in the fabric as it is being produced. Such fabric gap is needed for the production of, for example, two separate fabric widths simultaneously in the same air loom. A special salvage must be formed along the gap for each fabric width.

BACKGROUND INFORMATION

Such fabric gaps are needed, for example, to produce an insertion edge or special selvage by cutting the weft threads in this fabric gap region. For this purpose, it is known to position a weft thread inserter above the fabric gap, so that cutting the weft thread in the region of said fabric gap and then reinserting the weft thread ends along the gap to form an insertion selvage becomes possible.

The fabric gap is formed in that there are no warp threads in the region of the desired gap in the fabric, so that with the weft thread insertion the gap is crossed only by weft threads which are then present in the gap and cut to form two fabric widths simultaneously.

It is conventionally known to grasp and clamp each beat-up weft thread end with a weft thread end reinsertion device which is independent of the air nozzles which blow the weft thread through an air insertion channel. The reinsertion device reinserts the weft ends back into the shed whereby the weft ends upon beat-up form a fabric edge or selvage. A reed that extends over the entire fabric width is conventionally used in such looms. However, warp threads are not present in the reed or rather in the shed region where the desired fabric gap is to be formed.

It is a disadvantage of the known device that a reed extending over the entire fabric width is relatively costly. If the reed is damaged in any particular area, then it must be replaced as a whole unit.

A further disadvantage of known reeds is seen in that the mechanism forming the weft end reinsertion device must be arranged to be movable and drivable above the fabric web, so that said weft end reinsertion mechanism can be brought outside of the reed reach during the beat-up by the reed.

However, a weft thread end reinserter with a mechanism that is shiftable along the longitudinal axis of the warp threads has the disadvantage that a relatively large structural effort and expenditure are necessary to construct the complete weft thread end reinserter comprising scissors, a clamp and an insertion needle, so that the reinserter is movable longitudinally of the warp threads. Further, valuable time is lost in positioning the complete weft thread end reinserter after the beat-up motion by the reed is completed in order to start the weft insertion through the shed by the conventional air nozzles.

OBJECTS OF THE INVENTION

In view of the above it is the aim of the invention to achieve the following objects singly or in combination:

to construct an air loom of the type described above, so that a simple weft thread inserter can be provided at a lower manufacturing cost;

to construct a reed for an air loom in such a way that the weft inserter may be mounted in a stationary position;

to bring the beat-up weft thread in the fabric gap directly into a clamp; and to construct a reed in such a manner that the formation of a fabric gap is possible anywhere along the width of the fabric.

SUMMARY OF THE INVENTION

According to the invention the reed is divided into several reed sections spaced from each other across the fabric width. A reed breach is formed between each of two neighboring reed sections at the point or region where a fabric gap is desired. A reed filler member is positioned in the reed breach so that the filler member is aligned with the reed sections when the latter are in the rear position of the reed. The filler member does not follow the beat-up motion of the reed sections.

It is an essential characteristic of the present invention, that now there is no longer a single reed that extends over the entire fabric width. Rather, the present reed is divided into a desired number of reed sections that are mounted on a reed beam together, and the above mentioned reed breach exists between neighboring reed sections at each point where a fabric gap is to be formed. To guarantee a secure and undisturbed weft insertion motion, especially to guarantee that the weft thread to be inserted is not disturbed in the reed breach, the invention provides a reed filler member in the reed breach, which simulates the technical air characteristics of the air insertion channel of the reed in the breach region. Thus, the weft thread can be inserted without disturbance through the breach region and through the full length of the insertion channel over the entire fabric width. The arrangement of reed sections and reed filler members has the important advantage that the entire mechanism of a weft thread end reinserter can now be mounted in a stationary position and does no longer need an additional movement mechanism, as was necessary in the prior art.

It is important, that the reed filler member is mounted in a fixed position to the, frame of the weaving machine or loom, in such a way that the filler member is aligned with the reed sections when the reed sections are in the rear position of the reed, in which the weft thread insertion by the air nozzles is carried out. Only in this position must the reed filler member simulate the weft insertion channel in the reed breach, in order to guarantee an undisturbed insertion of the weft thread over the entire width of the fabric. In all other reed positions such a simulation is not necessary and therefore it is satisfactory if the reed filler member remains in the fixed stationary position during the beat-up motion of the reed and only fills out the reed breach when the reed is in its back position forming the shed.

When the reed sections are in the beat-up position of the reed, the reed filler member remains in its rear position, and the weft thread end reinserter with its insertion mechanism grabs through the reed breach. This feature achieves the essential advantage, that the entire insertion mechanism of the weft thread end reinserter need not be brought outside the beat-up range of the tiltable reed, since, as described above, the weft end reinserter can grab through the reed breach.

Instead of the weft thread end reinserter other fabric working aggregates or components may be provided. The arrangement of the weft thread end reinserter which essentially comprises a clamp, scissors, and corresponding insertion needles, is preferred, however. Instead of the weft thread end reinserter with needles, other selvage forming mechanisms may be used. For example, edge welding or adhesive edge bonding devices which could also have a clamp and scissors, but which do not reinsert the cut weft thread end, but rather weld or glue it, could be used instead of the reinserter.

The arrangement of a stationary weft end reinserter for forming a selvage even in the center of the fabric has the advantage, that now the beat-up weft thread must no longer be sought by a clamping and cutting mechanism. Rather, in the present invention, the beat-up weft thread is immediately brought to the range of an open clamp by the beat-up motion of the reed. This clamp then closes and holds the beat-up weft thread securely, whereby valuable time is gained, since the search process for the beat-up weft thread described above and necessary in the prior art, is no longer needed.

The beat-up weft thread is securely gripped and clamped and then cut. The resulting cut ends are reinserted by conventional insertion needles to form an insertion edge or selvage. As a result, the necessary mechanism is considerably less expensive, yet works faster, which makes it possible to run the weaving machine or loom at a higher rate and hence a higher output capacity is achieved.

From the above description it is seen that the reed filler section must simulate the air-technical characteristics of the reed more specifically of the air insertion channel through the reed only when the reed is in the shed back position or open position, that is during the weft thread insertion by the insertion jets of the air loom. Therefore, a first example embodiment provides that the reed filler member is constructed in the same manner as the other reed section, except that the reed filler member is kept stationary.

In another example embodiment of the present invention the reed filler member is formed as a simple plate in which an insertion channel is formed, e.g. machined.

In another example embodiment of the present invention a weft thread insertion relay nozzle is connected to the reed filler member in order to guarantee a carrying and guiding function for the weft thread that is being inserted and moves through the reed filler member in the reed breach.

The type and construction of the reed filler member also depends on the width of the desired fabric gap. If a relatively wide fabric gap is desired, then it is necessary to form the stationary reed filler member as similar as possible to the other movable reed sections, in order to prevent a disturbance of the weft thread. If only a narrow fabric gap is desired, then the air technical characteristics of the reed filler member are not so important whereby it is satisfactory to form the reed filler member as a solid plate with an air insertion channel machined into it, as mentioned above. Therefore, it is possible to adjust the width of the fabric gap to the technical weaving requirements and to form a gap width, for example, in the range of 10 mm to 100 mm.

A further advantage of the invention is seen in the reduction of the manufacturing costs for a reed constructed as taught herein. Since it is no longer necessary to manufacture a reed that extends over the entire fabric width, it is sufficient to attach several partial reed sections to the reed beam. If a reed section is damaged, then it is convenient to replace the damaged reed section, while the other reed sections remain unaffected.

According to the invention it is now possible to divide a reed into any number of reed sections with reed filler members arranged in the spacings or breaches between neighboring reed sections to cover the entire fabric width. It is also possible to provide such a reed breach or spacing with a reed filler member outside of the fabric width proper, in order to, for example, meet special working requirements in the edge or selvage region of the fabric.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
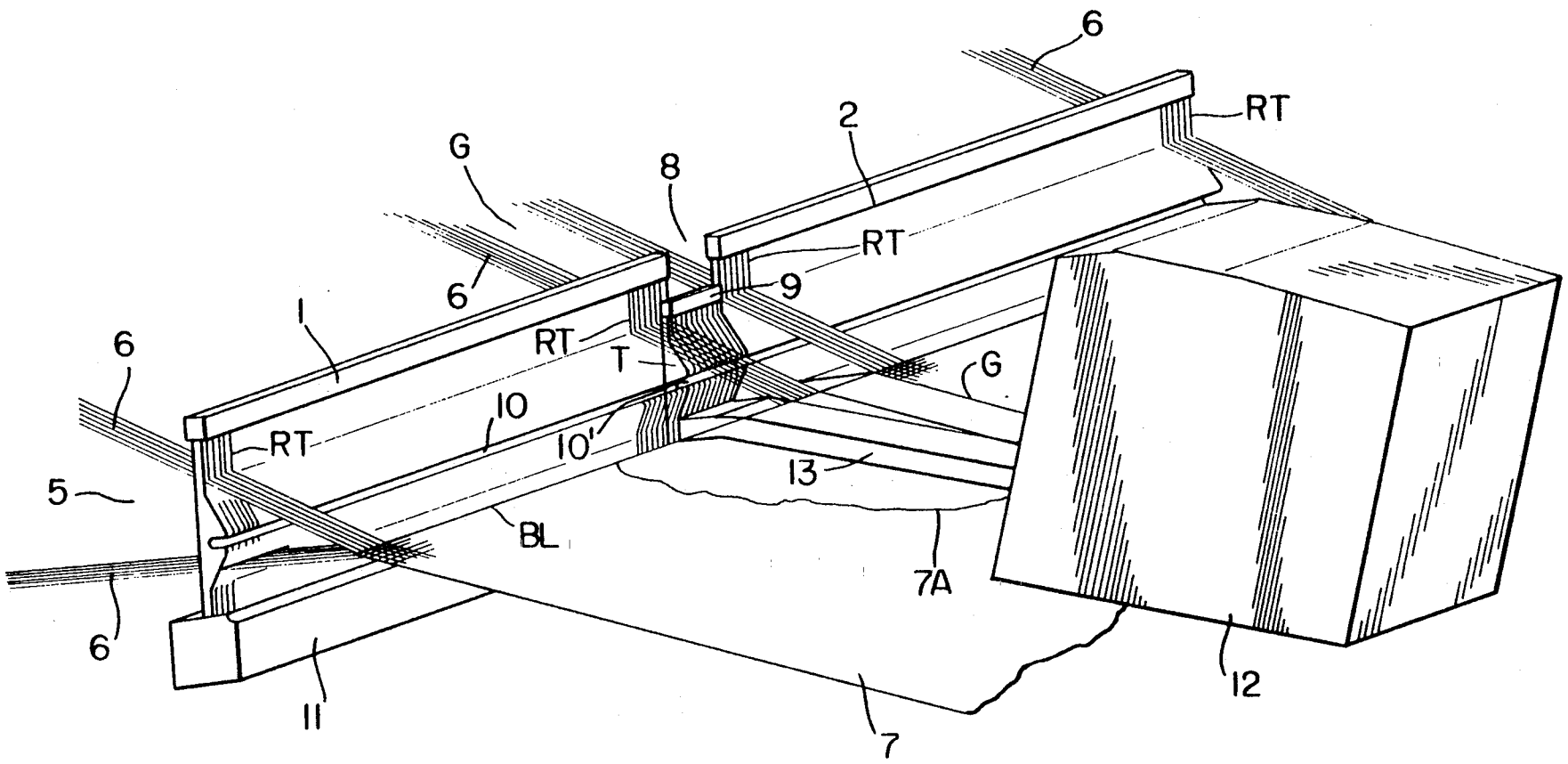
FIG. 1 shows a perspective, simplified view of the reed of an air weaving loom equipped with a divided reed according to the invention in a shed open or back position.
Figure 2:
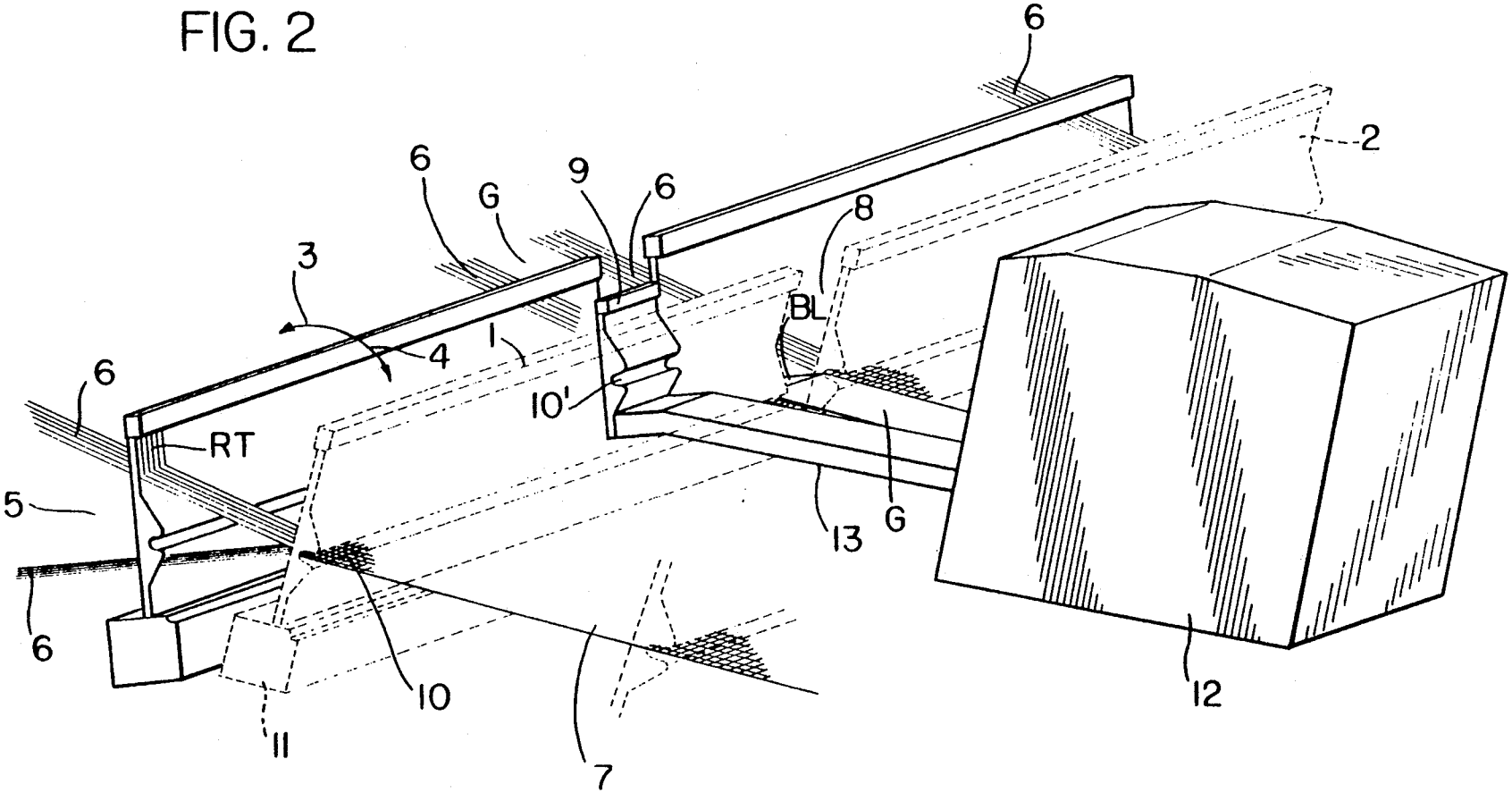
FIG. 2 shows the reed of FIG. 1 in the back position and in dashed line in the beat-up position.

According to FIG. 1, the present divided reed of an air loom has two reed sections 1 and 2 that are arranged in alignment with one another on a common reed beam 11. The two reed sections 1, 2 are spaced from each other by a reed breach 8, in the region where a desired fabric gap G is to be formed. As shown in FIGS. 1 and 2, warp threads 6 are not present in the gap G to be formed in the fabric 7. The breach 8 is filled by a reed filler member 9 mounted in a fixed position in alignment with the reed when the reed beam 11 is in its rear position during the weft thread insertion. Each reed section 1, 2 has reed teeth RT spaced from each other to guide warp threads 6 between neighboring teeth RT. These teeth are contoured to form an air insertion channel 10 for inserting weft threads into a loom shed 5.

It is important that, in the embodiment depicted in the drawings, the reed filler member 9 is constructed in the same way as the reed sections 1 and 2, whereby the number and spacing of the individual teeth in the reed filler member 9 are about the same as the number and spacing of the reed teeth RT in the reed sections 1, 2, as shown in FIG. 1.

It is an advantage that the reed filler member 9 needs to meet only approximately the air technical characteristics of the weft insertion channel 10. Thus, the reed filler member 9 can easily simulate the air insertion requirements, namely only so far as to ensure an undisturbed insertion of the weft thread in this back position or shed open position of the reed beam 11.

FIG. 1 shows, that the shed 5 is open and that, in this position, a weft thread is inserted into the weft insertion channel 10 of the reed sections 1 and 2 by an air insertion device that is not depicted in detail. The teeth T that form the weft insertion channel 10' of the reed filler member 9 are contoured in the same manner as the reed teeth RT whereby channel 10' is aligned with the weft insertion channel 10 of the reed sections 1, 2. The open shed of FIG. 2 is formed by the warp threads 6, and the fabric is 7 formed downstream of the beat-up line BL of the reed.

The reed filler member 9 is attached to a mounting member 13 that is securely fastened to the machine frame not shown. The weft thread end reinserter 12 can also be attached to the mounting member 13. Underneath the mounting member 13, the fabric gap G is formed in the direction of the longitudinal axis of the warp threads 6 in the fabric 7. The fabric 7 is broken away at 7A to show the mounting member 13 in full lines in FIG. 1.

FIG. 2 shows that the reed beam 11, which was previously tilted to the rear in the direction of arrow 3, is now tilted to the front in the direction of arrow 4 to perform the beat-up of the weft thread by the reed. Thus, the aforementioned breach 8 is formed and becomes visible. It is important that the reed filler member 9 remains in its rear position, while the reed sections 1, 2 are in the front position during the beat-up motion of the reed, so that the weft thread end reinserter 12 can grab into the newly formed reed breach 8 with its insertion mechanism, which, as described above, is attached stationarily to the machine frame. However, the individual working components of the inserter 12 are constructed to be movable, as is known, to be tiltable and slidable if necessary. It is an advantage of the invention that it is no longer necessary that the entire mechanism of the weft end reinserter 12 be constructed to be slidable in the longitudinal direction of the warp threads.

Figure 3:
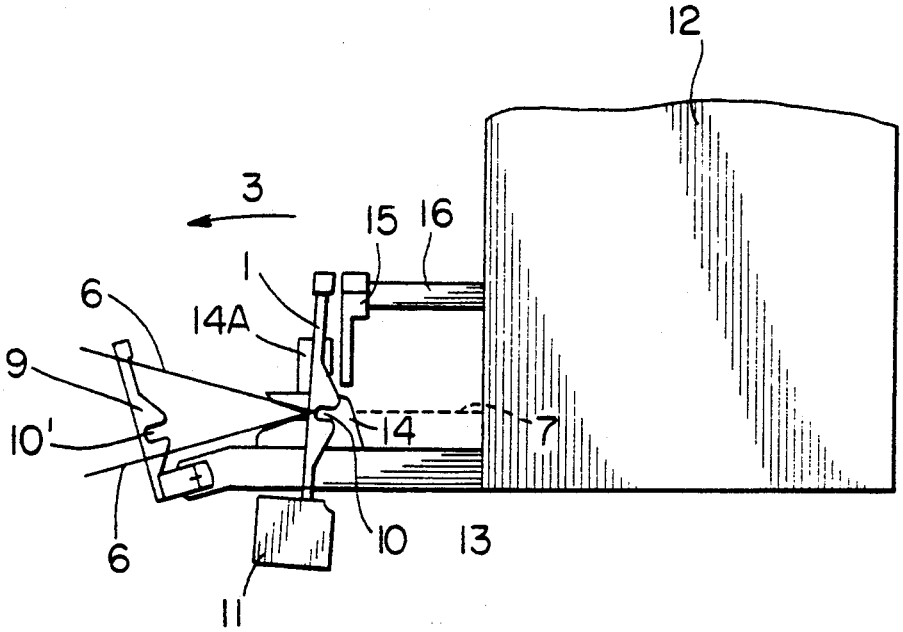
FIG. 3 is a side view of the present apparatus with the reed in the beat-up position and the filler member in its permanent back position.

FIG. 3 shows that the reed comprising the reed sections 1, 2 is swiveled toward the front in the direction of the arrow 4 to perform the beat-up by the reed, and that the weft thread end reinserter 12 with its insertion mechanism of which here only the scissors 14 and clamp 14A are shown, grabs into the reed breach 8.

One or more insertion needles 15 may be provided as shown schematically in FIG. 3, whereby each insertion needle 15 is arranged rotatably, and if needed, slidably on a shaft 16.

Although the invention has been described with reference to specific example embodiments it will be appreciated that it is intended to cover all modifications and equivalents within the scope of the appended claims.

What we claim is:

1. A combination comprising a weaving reed and reed filler member for forming a gap in a fabric produced on an air loom, said reed comprising a plurality of reed sections spaced from each other in a longitudinal reed direction cross-wise to a fabric feed advance direction, a breach between two neighboring reed sections for forming said fabric gap, said reed filler member being sized for fitting into said breach when said reed is in a shed open back position, and means for mounting said reed filler member in a stationary position wherein said reed filler member is in alignment with said reed sections when said reed sections are in said shed open back position, whereby said reed filler member remains constantly in said stationary position.

2. The combination of claim 1, wherein said reed sections have spaced reed teeth contoured to form an air insertion channel for weft threads, said reed filler member comprising teeth constructed and spaced as said reed teeth of said reed sections.

3. The combination of claim 2, wherein said reed filler member comprises a plate and a weft thread insertion channel machined in said plate for alignment with respective insertion channels in said reed sections.

* * * * *